US006367084B1

(12) United States Patent
Keast

(10) Patent No.: US 6,367,084 B1
(45) Date of Patent: Apr. 9, 2002

(54) HEADWEAR

(76) Inventor: Simon J. Keast, 109 Foxley Lane, Purley, Surry (GB), CR8 3HQ ( * ) Notice: Subject to any disclaimer, the term of this patent is extended or adjusted under 35 U.S.C. 154(b) by 0 days.

(21) Appl. No.: 09/623,558

(22) PCT Filed: Mar. 5, 1999

(86) PCT No.: PCT/GB99/00676

§ 371 Date: Sep. 6, 2000

§ 102(e) Date: Sep. 6, 2000

(87) PCT Pub. No.: WO99/44454

PCT Pub. Date: Sep. 10, 1999

(30) Foreign Application Priority Data

Mar. 7, 1998 (GB) ..... 9804757

(51) Int. Cl.[7] ..... A42B 1/00

(52) U.S. Cl. ..... 2/182.7; 2/195.1; 2/209.3

(58) Field of Search ..... 2/7, 195.1, 200.1, 2/182.7, DIG. 1, 181, 209.5, 209.13, 171.2, 171.3, 182.3, 184.5, 209.3, 425, 171

(56) References Cited

U.S. PATENT DOCUMENTS

| | | | | |
|---|---|---|---|---|
| 1,338,283 A | | 4/1920 | Bradley | |
| 1,810,157 A | | 6/1931 | Bullard | |
| 3,780,382 A | * | 12/1973 | Boden | 2/195 |
| 3,925,821 A | * | 12/1975 | Lewicki | 2/3 |
| 3,927,421 A | | 12/1975 | Simon | |
| 4,101,981 A | * | 7/1978 | Boden | 2/182.6 |
| 4,476,589 A | | 10/1984 | Burgin et al. | |
| 4,550,445 A | | 11/1985 | Fender | |
| 5,155,868 A | | 10/1992 | McLean, Jr. | |
| 5,839,121 A | * | 11/1998 | Morales | 2/7 |
| 5,887,276 A | * | 3/1999 | Lee | 2/7 |
| 5,887,289 A | * | 3/1999 | Theoret | 2/425 |

FOREIGN PATENT DOCUMENTS

| | | |
|---|---|---|
| GB | 19565 | 9/1911 |
| GB | L19565 A | 9/1911 |
| GB | 408138 | 2/1933 |
| GB | 481784 | 3/1937 |
| GB | 529716 | 4/1939 |

* cited by examiner

*Primary Examiner*—John J. Calvert
*Assistant Examiner*—Katherine Moran
(74) *Attorney, Agent, or Firm*—Nixon & Vanderhye P.C.

(57) ABSTRACT

Headwear in the form, for example, of a baseball cap (1) is provided in its front portion (4) with an inlet aperture (20) with which is associated a baffle (22) whereby in use on the wearer's head, midly turbulent air flow is induced into the cap space (10) by virtue of the baffle (22) thereby to create a cooling effect upon the wearer's head (8).

10 Claims, 5 Drawing Sheets

HEADWEAR

This invention concerns improvements in or relating to headwear and in particular, although not exclusively, has reference to headwear commonly known as a baseball cap.

Baseball caps and caps of that general ilk conventionally are provided with a crown having a front peak, the cap being provided with an adjustable headband to facilitate versatility in size fitment. The cap is usually open to some extent at the rear thereof in the occipital region and in some designs might have an air permeable area provided by for example a meshwork fabric to give a measure of ventilation to the scalp. It is also known to form ventilation apertures in the cap.

As will be appreciated, caps of this kind are worn principally during the summer season with the intention of affording protection to the wearer from the heat and glare of the sun. However, a practical disadvantage of currently available caps is that they fit in relatively close proximity to the scalp, if not in contact therewith, and thus tend to generate heat and this problem is especially acute for wearers who have experienced hair loss on the crown. Excessive perspiration results to the extent that the caps are removed thereby defeating the object of wearing them.

An object of the invention is to provide improved headwear which will facilitate air induction and air flow currents into and through the headwear.

According to the invention headwear comprises a crown portion of sufficient depth as in use to provide a space between its inner surface and the top of the wearer's head, a peak at the front of the crown portion, a head band defining the lower limit of the crown portion for locating and keeping the headwear on the wearer's head, characterised by an inlet aperture in the front of the crown either above or below the level of the peak for the introduction of air into the interior of the headwear, a projection associated with the inlet aperture for interrupting in use air flow passing through the aperture, and an outlet aperture in the occipital region of the crown.

Conveniently the headwear is in the form of a baseball cap. However, the headwear may be of other forms and in this connection the word 'peak' includes the front portion of a brim or its equivalent.

The inlet and outlet apertures may be weatherproofed to prevent or restrict the ingress of unwelcome precipitation in the form of for example rain. The weatherproofing may be effected by providing an overhang associated with the respective aperture.

The projection associated with the inlet aperture may be in the form of a baffle or blade depending from or constituting part of the relatively upper margin of the aperture for the purpose of interrupting in use the air flow therethrough to create a mild turbulence in the air flow thereby to enhance its cooling effect within the headwear. The baffle or blade may be provided with a sharp edge. In alternative embodiments, the baffle or blade may be located on the peak or on the front of the crown in association with the aperture, The aperture may be provided with a closure member which may be detachable or may be movable into and out of a closure position on the headwear. The degree to which the aperture is restricted by the closure member may advantageously be variable in order to cater for prevailing climatic conditions.

The internal surface of at least part of the crown of the headwear may be textured or contoured to provide a turbulence generating medium within the space between the wearer's head and the defining crown of the headwear, again to provide a cooling effect within that space.

Conveniently the outlet aperture of the headwear is also provided with a similar projection for the purpose of creating turbulence at the point of exit of the air flow from the headwear.

One or both projections may be provided with an internal textured or contoured surface with the same objective as that described for the internal surface of the headwear as such.

The head band may advantageously be formed with an absorbent layer or surface which is intended to be in contact with the wearer's head.

By way of example, one embodiment of headwear in accordance with the invention is described below with reference to the accompanying drawing in which.

Figure 1:
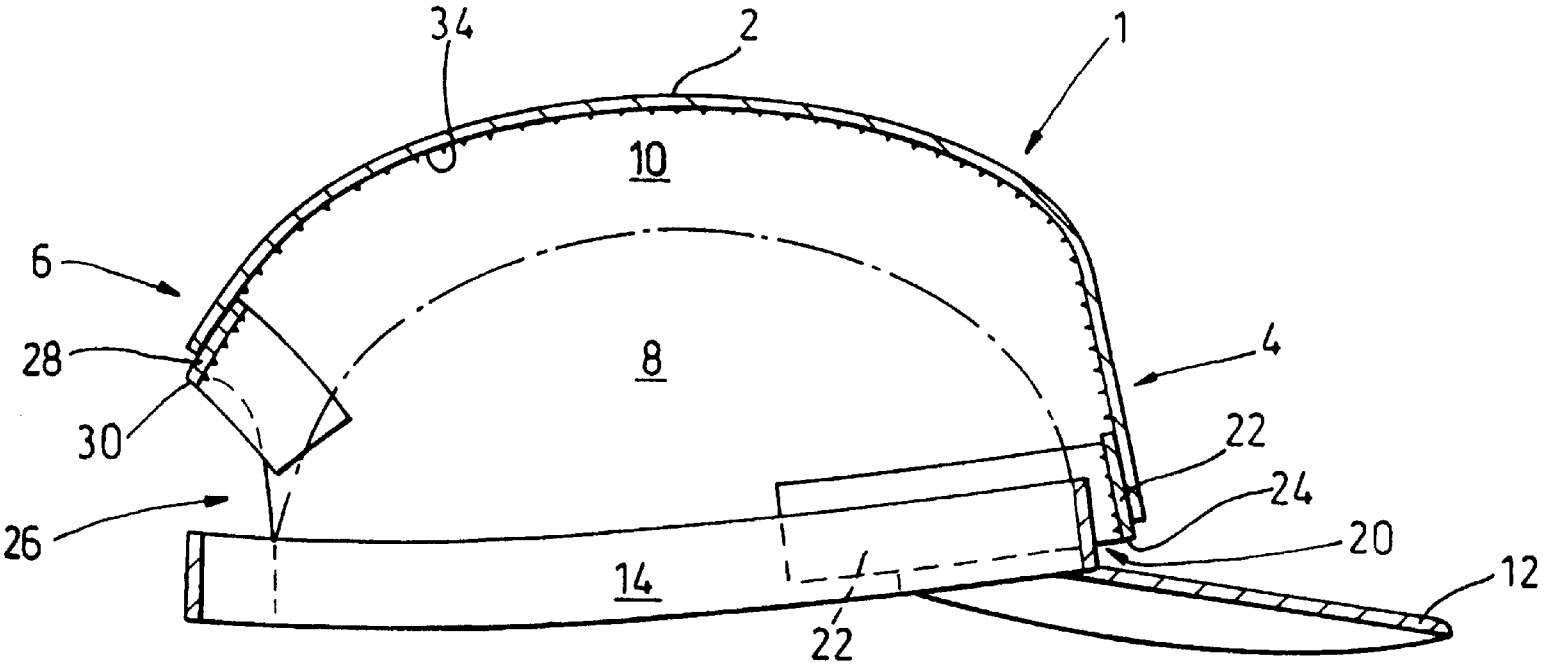
FIG. 1 is a cross sectional side elevation of a baseball cap.
Figure 2:
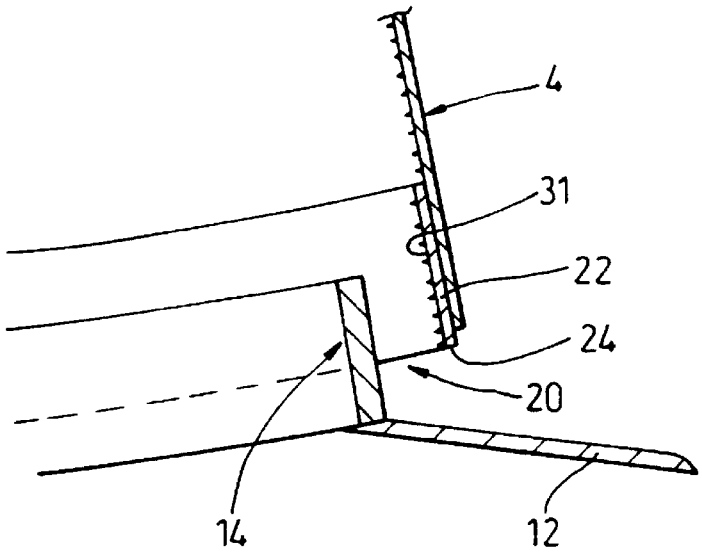
FIG. 2 is an exploded view of a first detail of the front portion of the cap shown in FIG. 1.
Figure 3:
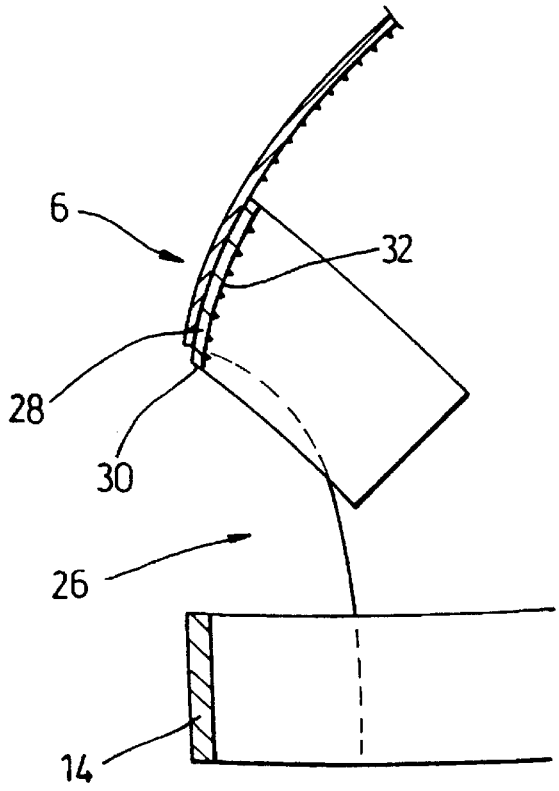
FIG. 3 is an exploded view of a second detail of the rear portion of the cap shown in FIG. 1.
Figure 4:
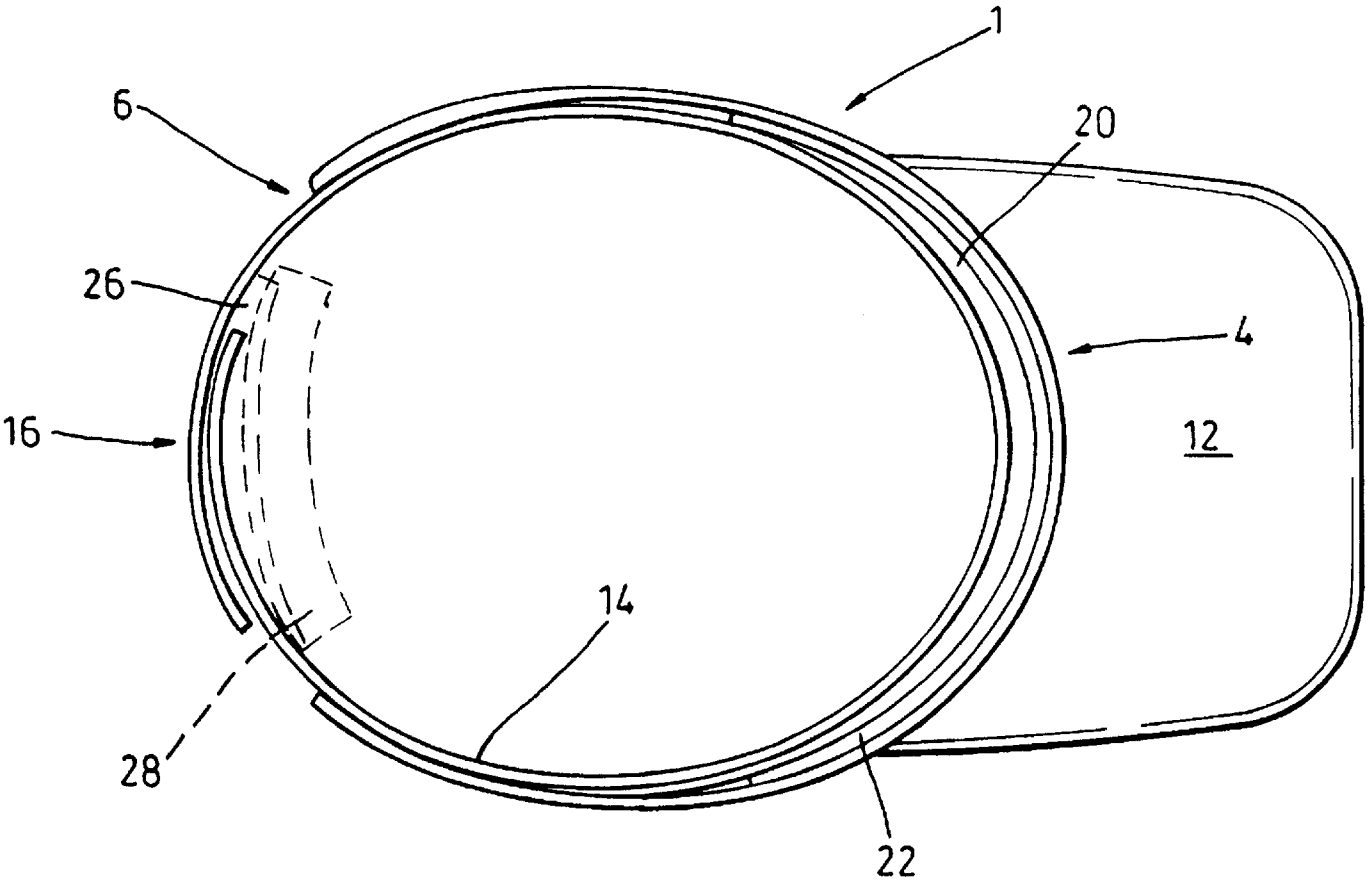
FIG. 4 is a cross sectional plan view of the baseball cap of FIG. 1.
Figure 5:
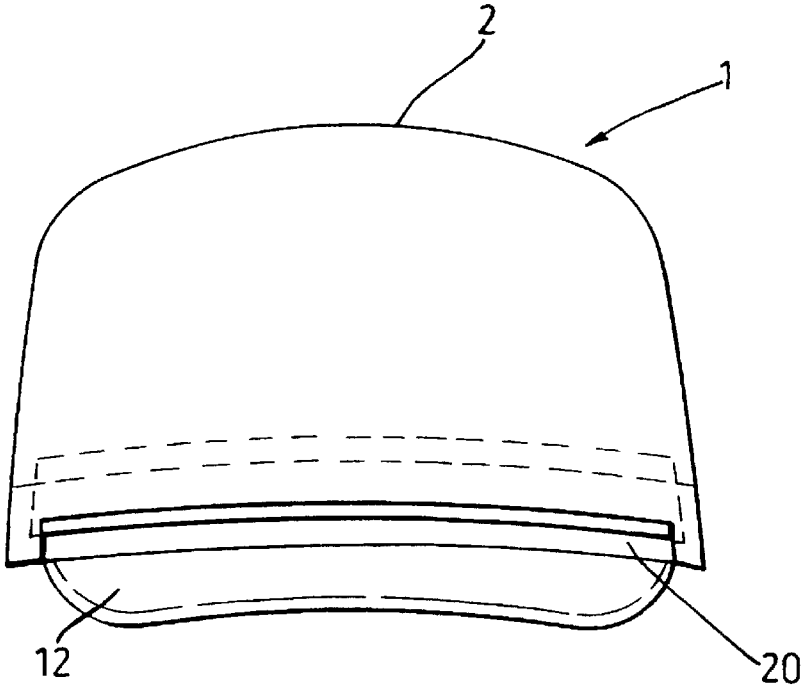
FIG. 5 is a front elevation of the cap.
Figure 6:
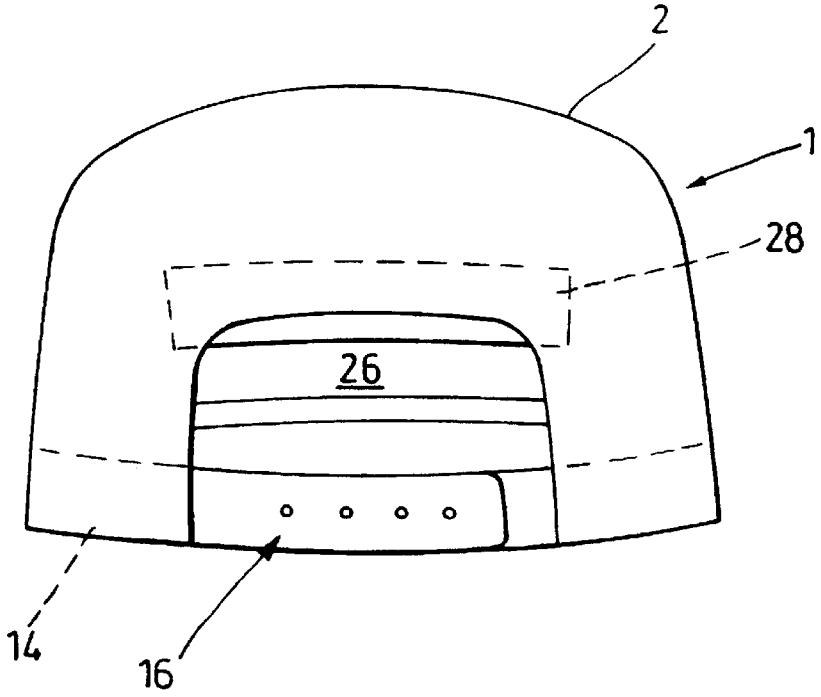
FIG. 6 is a rear elevation of the cap.
Figure 7:
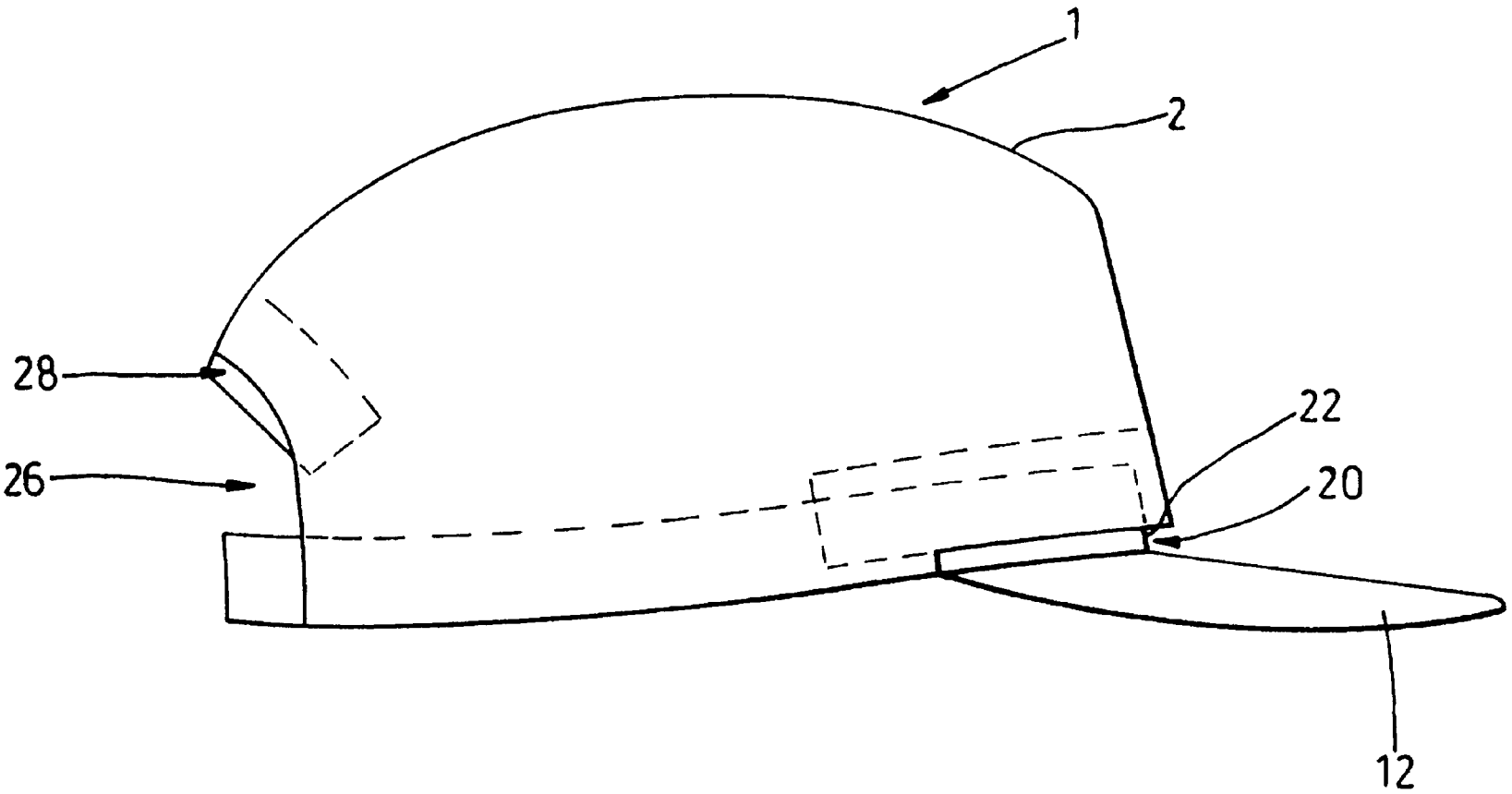
FIG. 7 is a side elevation of the cap.

Referring to the drawings, there is shown headwear in the form of a baseball cap 1 comprising a crown 2 of weather resistant material having a front portion 4 and a rear or occipital portion 6, the depth of the crown 2 being sufficient such that in position on a wearer's head 8 a space 10 is left for circulating air. The cap 1 has a peak 12 which extends at the front thereof from an adjustable head band 14, the adjustment being provided in conventional manner as at 16 at the rear portion 6 of the cap, the head band 14 having an absorbent inner lining for contact with a wearer's head and being integral with the crown or secured thereto in suitable fashion.

The front portion 4 of the crown 2 overhangs the head band 14 and is spaced therefrom and from the peak 12 to provide an inlet aperture 20 leading to the space 10. A baffle 22 having a leading edge 24 is affixed within the crown internally of the front portion 4 and depends into the aperture 20 as shown thereby partially to obstruct the aperture for the purpose in use of creating turbulence in the air flowing into the cap space 10.

The rear portion 6 of the crown 2 has an outlet aperture 26 and is similarly provided with a downwardly depending baffle 28 having a trailing edge 30 to perform the function of a turbulence generator in the occipital region of the wearer's head upon egress of the air flow from the interior of the cap.

The baffles 22 and 28 are conveniently formed of semi-rigid material provided with a textured surface 31, 32 respectively presented inwardly of the cap thereby to encourage further turbulence in the air flowing over the surfaces upon entry to and discharge from the cap space 10. Further, the internal surface of the crown 2 is also advantageously textured at 34 to give the same effect as with baffle surfaces.

The principle of operation of the new and improved headwear, in the form of a baseball cap in the example, is that either upon movement of the wearer during use or because of prevailing air flow conditions, i.e., wind conditions, air induction into the interior of the cap occurs whereupon the air flow is subjected to disturbance in the first instance by the baffle 22 and then by its surface 31 to create low friction turbulence which is perpetuated within the space by virtue of the texturing of the inner surface 34 of the crown and thence into and through the outlet aperture where again turbulence is enhanced by the textured surface 32 of the baffle 28 and its trailing edge. The turbulence in the air provides a circulating current of air within the cap thereby occasioning a cooling effect which is of particular benefit to those who have suffered hair loss, but is also beneficial generally in providing ventilation in a simple yet efficacious manner.

It is to be understood that whilst the baffles associated with the inlet and outlet apertures have been described as being blade like and therefore having straight edges, other shaped edges could well be employed, for example edges of serrated or profiled form could be usefully adopted. Furthermore, the baffles may be associated with any one or all margins of the relevant apertures. It is further to be understood that while the headwear of the invention has been described as having one aperture at the front and one at the rear portions of the crown, more than one aperture might be provided in each portion and the crown itself may have an aperture and an associated projection in the form of a baffle.

The headwear of the present invention may be manufactured from conventional materials.

It is to be understood that the front portion of the crown may be provided with a display area for brand marking.

What is claimed is:

1. Headwear comprising:

a crown portion of sufficient depth as in use to provide a space between an inner surface of the crown portion and the top of the wearer's head, the crown portion having a front, an occipital region and a lower limit, a peak at the front of the crown portion, a head band defining the lower limit of the crown portion for locating and keeping the headwear on the wearer's head, an inlet aperture in the front of the crown above the level of the peak for the introduction of air into the interior of the headwear, and an outlet aperture in the occipital region of the crown, wherein the inlet aperture has a relatively upper margin, a baffle depending from the relatively upper margin of the aperture and into the air flow into the aperture for interrupting in use the air flow passing through the aperture so as to create an initial turbulence of the air flow, and wherein at least part of the inner surface of the crown portion is textured to provide a turbulence-generating medium so as to perpetuate in use the turbulent air flow through the inlet aperture within the space between the inner surface of the crown portion and the wearer's head.

2. Headwear according to claim 1, wherein the inlet and outlet apertures are weatherproofed to prevent or restrict the ingress of precipitation.

3. Headwear according to claim 2, wherein the weatherproofing is effected by providing an overhang associated with the respective aperture.

4. Headwear according to claim 1, wherein the baffle is provided with a sharp edge.

5. Headwear according to claim 1, wherein the outlet aperture of the headwear is also provided with a similar baffle for the purpose of creating turbulence at the point of exit for the airflow from the headwear.

6. Headwear according to claim 1, wherein the head band is formed with an absorbent surface which is intended to be in contact with the wearer's head.

7. A baseball cap comprising:

a crown portion of sufficient depth as in use to provide a space between an inner surface of the crown portion and the top of the wearer's head, the crown portion having a front, an occipital region and a lower limit, a peak at the front of the crown portion, a head band defining the lower limit of the crown portion for locating and keeping the headwear on the wearer's head, an inlet aperture in the front of the crown above the level of the peak for the introduction of air into the interior of the headwear, and an outlet aperture in the occipital region of the crown, wherein the inlet aperture has a relatively upper margin, a baffle depending from the relatively upper margin of the aperture and into the air flow into the aperture for interrupting in use the air flow passing through the aperture so as to create an initial turbulence of the air flow, and wherein at least part of the inner surface of the crown portion is textured to provide a turbulence-generating medium so as to perpetuate in use the turbulent air flow through the inlet aperture within the space between the inner surface of the crown portion and the wearer's head.

8. Headwear comprising:

a crown portion of sufficient depth as in use to provide a space between an inner surface of the crown portion and the top of the wearer's head, the crown portion having a front, an occipital region and a lower limit, a peak at the front of the crown portion, a head band defining the lower limit of the crown portion for locating and keeping the headwear on the wearer's head, an inlet aperture in the front of the crown above the level of the peak for the introduction of air into the interior of the headwear, and an outlet aperture in the occipital region of the crown, wherein the inlet aperture has a relatively upper margin, a baffle depending from the relatively upper margin of the aperture and into the air flow into the aperture for interrupting in use the air flow passing through the aperture so as to create an initial turbulence of the air flow, and wherein at least part of the inner surface of the crown portion is contoured to provide a turbulence-generating medium so as to perpetuate in use the turbulent air flow through the inlet aperture within the space between the inner surface of the crown portion and the wearer's head.

9. Headwear comprising:

a crown portion of sufficient depth as in use to provide a space between its inner surface and the top of the wearer's head, the crown portion having a front, an occipital region and a lower limit, a peak at the front of the crown portion, a head band defining the lower limit of the crown portion for locating and keeping the headwear on the wearer's head, and an inlet aperture in the front of the crown above the level of the peak for the introduction of air into the interior of the headwear, wherein the inlet aperture has a relatively upper margin, a baffle depending from the relatively upper margin of the aperture for interrupting in use the air flow passing through the aperture, and an outlet aperture in the occipital region of the crown, wherein at least part of the crown includes an internal surface which is textured to provide a turbulence-generating medium, and wherein the baffle is provided with an internal textured surface.

10. Headwear comprising:

a crown portion of sufficient depth as in use to provide a space between its inner surface and the top of the wearer's head, the crown portion having a front, an occipital region and a lower limit, a peak at the front of the crown portion, a head band defining the lower limit of the crown portion for locating and keeping the headwear on the wearer's head, and an inlet aperture in the front of the crown above the level of the peak for the introduction of air into the interior of the headwear, wherein the inlet aperture has a relatively upper margin, a baffle depending from the relatively upper margin of the aperture for interrupting in use the air flow passing through the aperture, and an outlet aperture in the occipital region of the crown, and wherein at least part of the crown includes an internal surface which is textured to provide a turbulence-generating medium, and wherein the baffle is provided with an internal contoured surface.

* * * * *